US007952532B2

(12) United States Patent
Tanabe

(10) Patent No.: US 7,952,532 B2
(45) Date of Patent: May 31, 2011

(54) ANTENNA DEVICE, FEED CIRCUIT, AND RADIO-WAVE TRANSMISSION/RECEPTION METHOD

(75) Inventor: Kosuke Tanabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 12/919,453

(22) PCT Filed: Feb. 25, 2009

(86) PCT No.: PCT/JP2009/053437
§ 371 (c)(1),
(2), (4) Date: Aug. 25, 2010

(87) PCT Pub. No.: WO2009/110361
PCT Pub. Date: Sep. 11, 2009

(65) Prior Publication Data

US 2011/0006966 A1 Jan. 13, 2011

(30) Foreign Application Priority Data

Mar. 7, 2008 (JP) ..... 2008-057707

(51) Int. Cl.
*H01Q 21/22* (2006.01)

(52) U.S. Cl. ..... 343/853; 343/700 MS; 342/372

(58) Field of Classification Search ..... 343/853, 343/700 MS; 342/372, 383; 333/100, 101
See application file for complete search history.

(56) References Cited

U.S. PATENT DOCUMENTS

| | | | | | |
|---|---|---|---|---|---|
| 2,286,839 | A | * | 6/1942 | Schelkunoff | 343/844 |
| 3,293,648 | A | * | 12/1966 | Kuhn | 342/368 |
| 3,631,503 | A | * | 12/1971 | Tang et al. | 343/754 |
| 4,231,040 | A | * | 10/1980 | Walker | 342/373 |
| 5,404,145 | A | * | 4/1995 | Sa et al. | 343/700 MS |
| 5,952,965 | A | * | 9/1999 | Kowalski | 342/372 |
| 7,324,060 | B2 | * | 1/2008 | Quan et al. | 343/853 |

FOREIGN PATENT DOCUMENTS

| | | | |
|---|---|---|---|
| JP | 5-36915 | A | 5/1993 |
| JP | 7-170122 | A | 7/1995 |
| JP | 7-183724 | A | 7/1995 |
| JP | 11-205027 | A | 7/1999 |
| JP | 2003318649 | A | 11/2003 |
| JP | 2004040299 | A | 2/2004 |
| JP | 2005064934 | A | 3/2005 |
| JP | 2006197530 | A | 7/2006 |
| JP | 2007295345 | A | 11/2007 |
| JP | 2007300196 | A | 11/2007 |

OTHER PUBLICATIONS

International Search Report for PCT/JP2009/053437 mailed May 26, 2009.

S. Adachi. "Electromagnetic Wave Engineering", Corona Publishing Co.,LTD 1983, pp. 117.

* cited by examiner

*Primary Examiner* — Tho G Phan

(57) ABSTRACT

An antenna device of the invention comprises divider/combiner means 12 that divides or combines a received signal into signals having a first phase distribution represented by an odd function, phase adding/removing means 14-1 that adds phases having a second phase distribution represented by an even function to the signals, or removes the phases from the signals, and a plurality of antenna elements 20 arranged in an array configuration, that transmits or receives the signals to which the phases have been added.

17 Claims, 9 Drawing Sheets

ANTENNA DEVICE, FEED CIRCUIT, AND RADIO-WAVE TRANSMISSION/RECEPTION METHOD

This application is the National Phase of PCT/JP2009/053437, filed Feb. 25, 2009, which is based upon and claims the benefit of priority from Japanese Patent Application No. 2008-057707 filed on Mar. 7, 2008, the content of which is incorporated by reference.

TECHNICAL FIELD

The present invention relates to an antenna device, a feed circuit, and a radio-wave delivery method for use in a radio system such as a portable telephone, a wireless LAN (Local Area Network), WiMAX (Worldwide Interoperability for Microwave Access) and the like.

BACKGROUND ART

An antenna device for use in a base station for portable telephones and the like comprises an antenna array which is made up of a plurality of antenna elements. A description will be given of the characteristics of radio-waves delivered from an antenna device including a plurality of antenna elements to a terminal station.

FIG. 1 is a perspective view showing an exemplary configuration of an antenna device. Here, as shown in FIG. 1, 13 antenna elements 120 are arranged at equal intervals in a line in a direction perpendicular to the ground. Each of antenna elements 120 is connected to feed circuit 100.

FIG. 2 is a graph showing an example of an amplitude distribution and a phase distribution. The vertical axes of the graph indicate the amplitude on the left scale and the phase on the right scale. The sign of the phase indicates an advanced phase when it is positive, and a delayed phase when it is negative. The horizontal axis of the graph represents numbers of antenna elements 120. This number indicates the location of the antenna element.

The centrally positioned antenna element is given number "0" among 13 antenna elements 120, antenna elements on one side of the antenna element No. 0 are given numbers with plus sign in order, and antenna elements on the other side of the antenna element No. 0 are given numbers with minus sign in order. The antenna elements positioned at both ends in the linearly arranged ones are given number "−6" and "+6." In the following, the side accompanied with the plus numbers are called the plus side, while the side accompanied with the minus numbers are called the minus side.

The values of amplitude and phase plotted on the graph of FIG. 2 indicate the amplitude and phase of a radio-wave at each antenna element. The amplitude and phase at the central antenna elements are zero, respectively, because they are used as the basis.

As shown in FIG. 2, the amplitude distribution reaches a maximum at antenna element No. 0 at the center, and presents a value which decreases as the absolute value of the number of the antenna element increases. The amplitude distribution exhibits an even function characteristic which has a central axis that passes through antenna element No. 0.

As shown in FIG. 2, the phase distribution exhibits a characteristic which includes a step near the center. The radio-waves are equal in phase at antenna elements +1 through +6, and connecting the values of the respective phases result in a flat distribution without unevenness. The phases of radio-waves at antenna elements of No. −1 through No. −6 also exhibit a flat distribution like the plus number side. The phase distribution presents an odd function characteristic which has its origin at antenna element No. 0.

While FIG. 2 shows a phase distribution which includes a flat portion, the phase distribution may include inclined portions. However, the angles of the slope are the same on the plus side and minus side of the antenna elements. The phase distribution also exhibits an odd function characteristic in this case.

Next, a description will be given of a radiation pattern when radio-waves delivered from an antenna device are combined.

FIG. 3 is a graph showing an example of a radiation pattern for the radio-waves which exhibit the characteristic shown in FIG. 2. The vertical axis of the graph represents the gain, while the horizontal axis represents the angle where the horizontal direction of antenna elements 120 is determined to be at 90 degrees. As shown in FIG. 1, a sky side from antenna element 120 covers a range from 90 degrees to 0 degree on the horizontal axis of the graph, while a ground side from antenna element 120 covers a range from 90 degrees to 180 degrees on the horizontal axis of the graph.

A solid line in FIG. 3 represents a radiation pattern of the antenna which exhibits the characteristic shown in FIG. 2, and a broken line represents an ideal characteristic. The ideal radiation pattern is a cosec square curve. The radiation pattern by the radio-waves with the amplitude distribution and phase distribution shown in FIG. 2 forms a null fill beam. JP2006-197530A (hereinafter, called "Document 1"), for example, discloses the configuration, amplitude distribution, and phase distribution of an antenna which forms a null fill beam.

On the other hand, an example of a method of approaching a radiation pattern to an ideal one is disclosed on Page 117 of "Electromagnetic Wave Engineering" (written by Saburo Adachi, and published by Colona Publishing Co., Ltd in 1983, hereinafter called "Document 2").

DISCLOSURE OF INVENTION

As shown in FIG. 3 the actual radiation pattern presents large errors (ripples) over the ideal one. In the antenna with the amplitude distribution and phase distribution shown in FIG. 2, the radio-wave propagation characteristics vary due to actual shifts from the ideal radiation pattern, resulting in a problem of deteriorated communication quality in a base station area. This problem is similarly found in the null fill antenna disclosed in Document 1.

Generally, when one attempts to realize an ideal radiation pattern with an antenna array comprising a finite number of antenna elements, the larger the number of antenna elements, the smaller is the difference between the obtained radiation pattern and the ideal pattern, and the obtained radiation pattern will approach to ideal characteristics. On the contrary, a smaller number of antenna elements causes larger errors with the ideal pattern. This is also applied when the ideal radiation pattern is a null fill beam.

For reducing errors between a radiation pattern and an ideal pattern, the number of antenna elements must be increased as much as possible, but an increased number of antenna elements causes another problem of an increase in size of an overall antenna.

The method disclosed in Document 2, on the other hand, suffers from restrains such as a large number of antenna elements, variations in intervals between antenna elements, and the like, and has the problem in which the degree of design freedom is limited.

An exemplary object of the invention is to provide an antenna device, a feed circuit, and a radio-wave transmission/ reception method which improve the characteristics of a radiation pattern without increasing the number of antenna elements.

An antenna device according to an exemplary aspect of the invention includes divider/combiner means that divides or combines a received signal into signals having a first phase distribution represented by an odd function, phase adding/removing means that adds phases having a second phase distribution represented by an even function to the signals, or removes the phases from the signals, and a plurality of antenna elements arranged in an array configuration, that transmits or receives the signals to which the phases have been added.

Also, a feed circuit according to an exemplary aspect of the invention, that is connected to a plurality of antenna elements arranged in an array configuration, includes a divider/combiner circuit that divides or combines a received signal into signals having a first phase distribution represented by an odd function, and a phase circuit that adds phases having a second phase distribution represented by an even function to the signals, or that removes the phases from the signals.

Also, a radio-wave transmission/reception method according to an exemplary aspect of the invention includes dividing a received signal into signals having a first phase distribution represented by an odd function, adding phases having a second phase distribution represented by an even function to the signals, and transmitting the signals to which the phases have been added.

Further, a radio-wave transmission/reception method according to an exemplary aspect of the invention includes receiving signals combined with a first phase distribution represented by an odd function and a second phase distribution represented by an even function, removing phases having the second phase distribution from the signals, and combining signals having the first phase distribution.

EXPLANATION OF REFERENCE

10 feed circuit
12 divider/combiner circuit
14-1, 14-2, 14-3 phase circuits
20 antenna element
141*a*-141*d*, 143*a*-143*d* transmission lines
145 variable phase shifter

BEST MODE FOR CARRYING OUT THE INVENTION

First Embodiment

Figure 4:
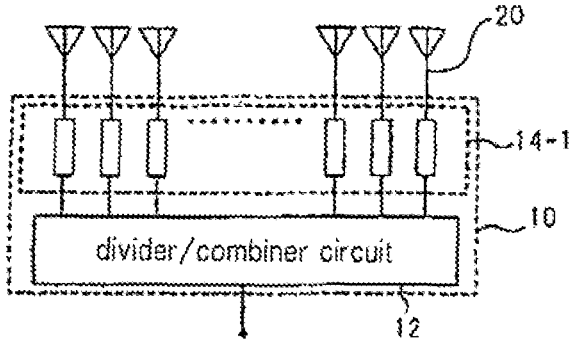
FIG. 4 is a block diagram showing an exemplary configuration of an antenna device according to a first embodiment.

An antenna device of this embodiment will be described in terms of configuration. FIG. 4 is a block diagram showing an exemplary configuration of the antenna device according to this embodiment.

The antenna device of this embodiment is installed in a base station device, not shown. The antenna device comprises a plurality of antenna elements 20 and feed circuit 10. Feed circuit 10 comprises divider/combiner circuit 12 and phase circuit 14-1.

A plurality of antenna elements 20 are arranged side by side. The shape of the antenna elements is, for example, a patch antenna, a dipole antenna or the like. In this embodiment, since the shape of the antenna elements are generally known, the shape is omitted in the illustration.

Divider/combiner circuit 12 comprises one input port and a plurality of output ports. The input port is connected to the body of a base station, not shown. The plurality of output ports are connected to phase circuit 14-1.

Divider/combiner circuit 12 functions as an ordinary feed circuit. Divider/combiner circuit 12, upon receipt of a signal, which is to be radiated, from the body of the base station (not shown), divides the signal into radio-waves of a predetermined amplitude distribution and phase distribution which serve as a basis for forming a null fill beam. An example of the predetermined amplitude distribution and phase distribution are those distributions shown in FIG. 2. Divider/combiner circuit 12 is comprised of micro-strip lines formed, for example, of a printed circuit board.

Figure 5:
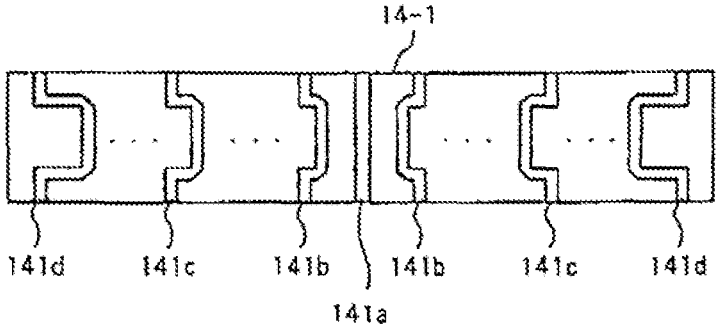
FIG. 5 is a diagram showing an exemplary configuration of a phase circuit in the first embodiment.

Phase circuit 14-1 is disposed between antenna element 20 and divider/combiner circuit 12. FIG. 5 shows an exemplary configuration of the phase circuit.

As shown in FIG. 5, phase circuit 14-1 comprises transmission lines 141*a*-141*d*, such as micro-strip lines or the like, routed on the printed circuit board in correspondence to antenna element 20. While transmission lines are also routed between transmission line 141*b* and transmission line 141*c* and between transmission line 141*c* and transmission line 141*d*, shown in FIG. 5, these transmission lines are omitted in the illustration.

In this embodiment, transmission line 141*a* is connected to the central element within a plurality of antenna elements 20 arranged side by side. Other transmission lines 141*b*-141*d* are adjusted in length such that they are in line symmetry about central transmission line 141*a*. Also, transmission lines 141*b*-141*d* are adjusted in length such that the phase is delayed more at a transmission line further away from central transmission line 141*a*. Respective transmission lines 141*a*-141*d* are adjusted in length such that the phase of a radio-wave input from divider/combiner circuit 12 is converted to a predetermined phase. Phase circuit 14-1 adds a predetermined phase distribution to a radio-wave received from divider/combiner circuit 12. The phase distribution added to a radio-wave by phase circuit 14-1 will be described later in detail.

For purposes of description, phase circuit 14-1 converts the phase characteristic of a radio-wave received from divider/combiner circuit 12, but alternatively, divider/combiner circuit 12 may include the configuration of phase circuit 14-1.

Next, a description will be given of the characteristics of a radio-wave delivered from each antenna element of the antenna device according to this embodiment.

Figure 6:
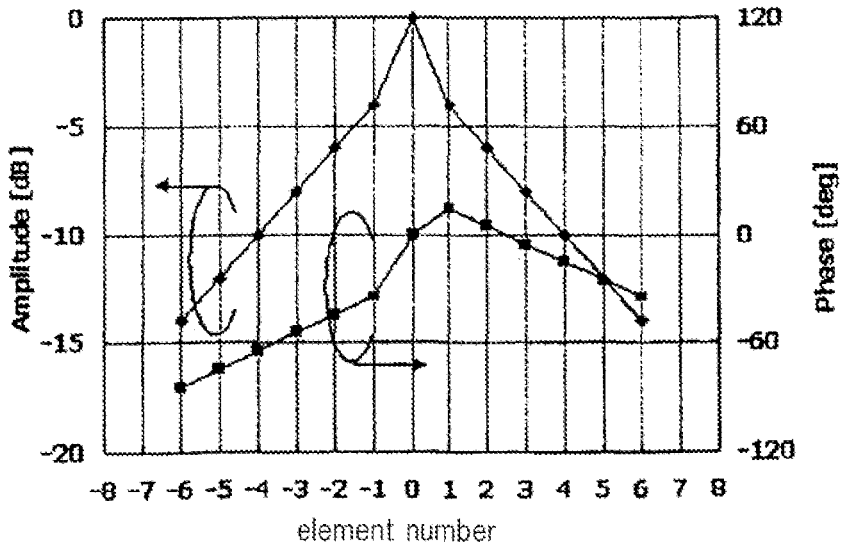
FIG. 6 is a graph showing an example of an amplitude distribution and a phase distribution of the first embodiment.

FIG. 6 is a graph showing an amplitude distribution and a phase distribution in each antenna element of the antenna device of this embodiment. Here, there are 13 antenna elements. The horizontal axis shows numbers indicative of the locations of the antenna elements. Since the locations of the antenna elements are similar to those described in FIG. 2, a detailed description will be omitted. The vertical axis represents the amplitude on the left scale, and represents the phase on the right scale. The sign of the phase indicates an advanced phase when it is positive, and a delayed phase when it is negative. Antenna element 20 that is labeled element number 0 presents the value of zero for the amplitude distribution and phase distribution, respectively, as the basis therefor.

As shown in FIG. 6, the amplitude distribution reaches a maximum at antenna element No. 0 at the center, and presents a value which decreases as the absolute value of the number of the antenna element increases. The amplitude distribution exhibits an even function characteristic which has a central axis that passes through antenna element No. 0.

The phase distribution in the radio-waves of this embodiment includes a straight line at a constant slope from antenna element No. +1 to antenna element No. +6. Also, the phase distribution includes a straight line at a constant slope from antenna element No. −1 to antenna element No. −6. The straight line accompanied with plus numbers of antenna elements differs from the straight line accompanied with minus numbers of antenna elements in the sign of slope, but their slopes have an equal absolute value.

Next, a description will be given of a method of forming the phase distribution shown in FIG. 6.

Figure 7:
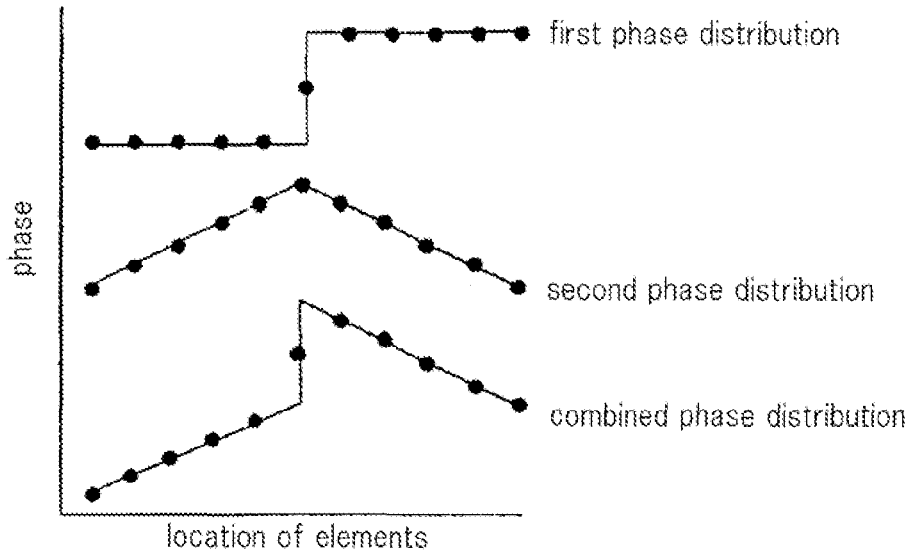
FIG. 7 is a diagram for describing a phase combination method in the first embodiment.

FIG. 7 is a diagram for describing a phase combination method in this embodiment. The horizontal axis represents the location of antenna elements, and the vertical axis represents the phase. The locations of the antenna elements are similar to those described in FIG. 2.

Assume that a first phase distribution is a phase distribution of a radio-wave generated by divider/combiner circuit 12, and a second phase distribution is a phase distribution added to the first phase distribution by phase circuit 14-1. FIG. 7 shows the first phase distribution, the second phase distribution, and a combined phase distribution which is a combination of these two phase distributions.

Figure 1:
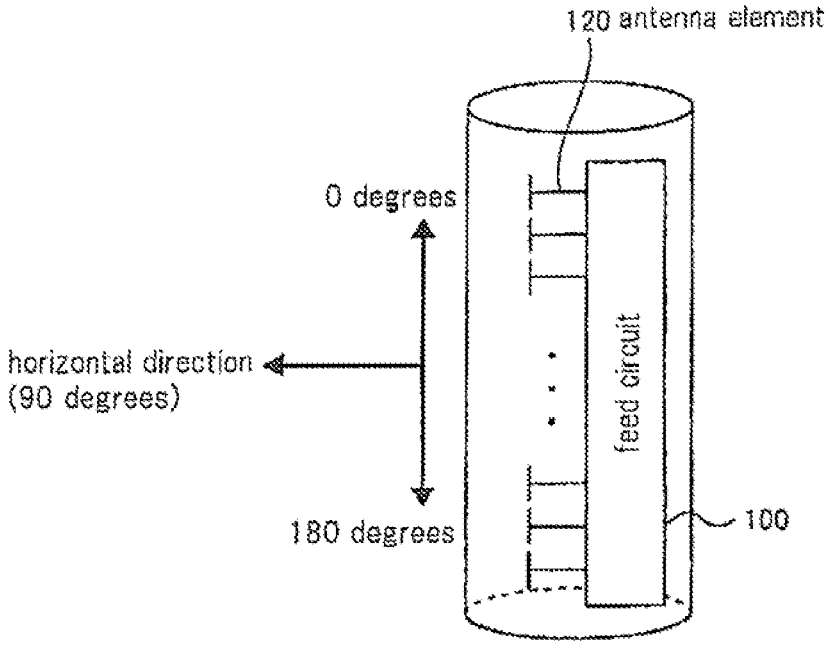
Fig.1 (Related Art)
FIG. 1 is a perspective view showing an exemplary configuration of a related antenna device.
Figure 2:
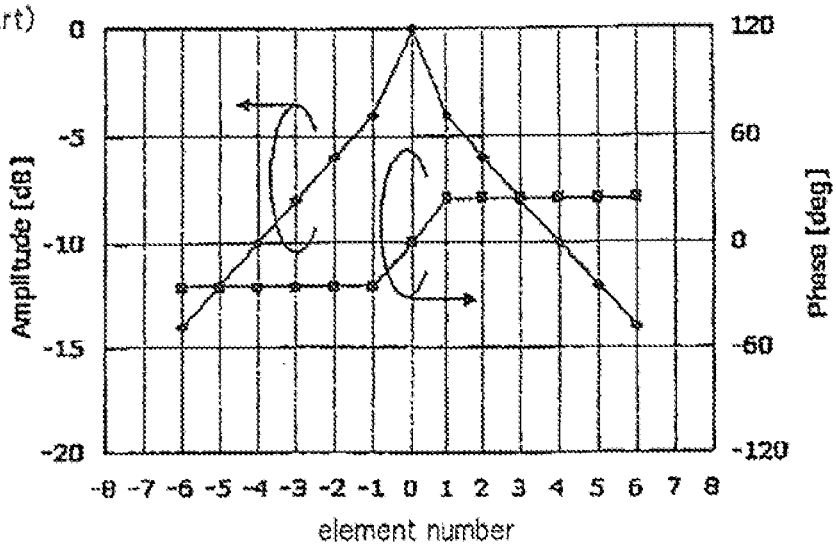
Fig.2 (Related Art)
FIG. 2 is a graph showing an example of an amplitude distribution and a phase distribution of the related antenna device.
Figure 3:
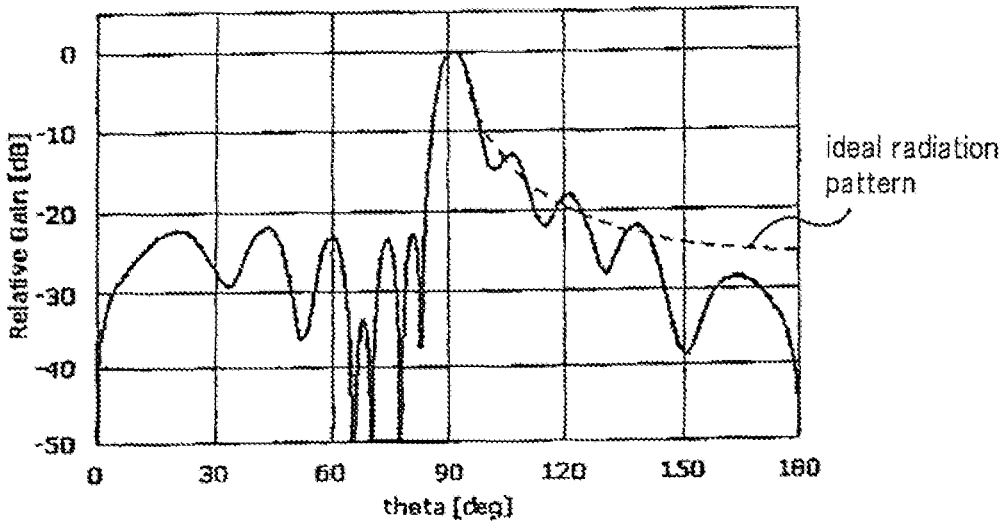
Fig.3 (Related Art)
FIG. 3 is a graph showing a radiation pattern for radio-waves with the characteristics shown in FIG. 2.

The first phase distribution shown in FIG. 7 is similar to the phase distribution shown in FIG. 2. The phase distribution includes a step near the center, and a flat distribution is presented by the phase of radio-waves at the antenna elements from No. +1 to No. +6. Likewise, a flat distribution is presented by the phase of radio-waves at the antenna elements from No. −1 to No. −6. The phase distribution exhibits an odd function characteristic that originated from antenna element No. 0. Also, the flat portions of the phase distribution may be inclined in a manner similar to that described in FIG. 2.

As shown in FIG. 7, the second phase distribution presents the shape of a mountain with uniformly inclined straight lines, respectively, on the plus side and minus side of the antenna elements, centered at antenna element No. 0, that are connected to each other at the center. The phase delays at a location further away from the central antenna element. The straight line on the plus side and the straight line on the minus side are represented by linear functions, and are different from each other as regards the sign of slope, but are equal in the absolute value of slope. Accordingly, the second phase distribution exhibits an odd function characteristic centered on a vertical axis which passes through antenna element 20 No. 0.

The combined phase distribution presents a uniformly inclined straight line from antenna element No. +1 through antenna element No. +6, as is the case with that described in FIG. 6. Also, the combined phase distribution presents a uniformly inclined straight line from antenna element No. −1 to antenna element No. −6. The straight line on the plus side and the straight line on the minus side are different from each other as regards the sign of slope, but are equal in the absolute value of slope.

Next, a description will be given of a radiation pattern by the antenna device of this embodiment.

Figure 8:
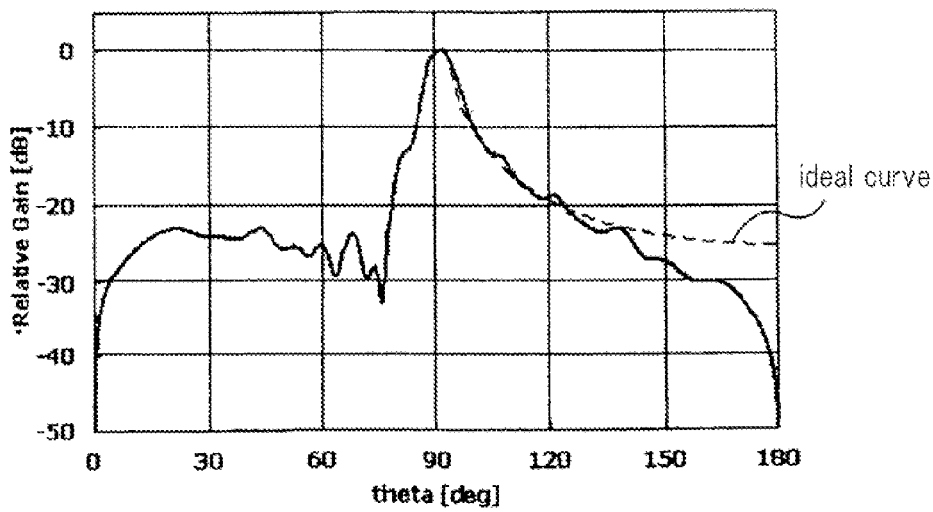
FIG. 8 is a graph showing a radiation pattern by the antenna device of the first embodiment.

FIG. 8 is a graph showing a radiation pattern by the antenna device of this embodiment. The vertical axis of the graph represents the gain. The horizontal axis of the graph represents the angle which is defined when the horizontal direction of the antenna elements is determined to be at 90 degrees. A left-hand side of the graph from the center (90 degrees) of the antenna elements shows a sky side, while the right-hand side of the graph shows a ground side. Since the scaling of the horizontal axis is similar to that described in FIG. 2, a detailed description is omitted. A radiation pattern depicted by a solid line is generated when 13 antenna elements 20 are arranged at intervals of approximately 0.7λ (λ is the wavelength of a radio-wave which is to be radiated) in a direction perpendicular to the ground. A broken line represents an ideal curve (cosec square curve).

Since radio-waves can cause radio-wave interference with satellites on the sky side from antenna elements 20, it is believed that the gain of the radiation pattern should be as low as possible. Thus, as shown in FIG. 8, the gain of the radiation pattern on the sky side of antenna elements 20 is lower than −20 dB, and is generally constant irrespective of the angle.

On the other hand, on the ground side of antenna elements 20, the propagation characteristics are improved irrespective of the distance between a base station and a terminal station within a coverage, so that it is believed that a null fill beam such as cosec square characteristic is appropriate. In the antenna device of this embodiment, a null fill beam characteristic, as shown in FIG. 8, well fit an ideal radiation pattern on the ground side of antenna elements 20.

Figure 9:
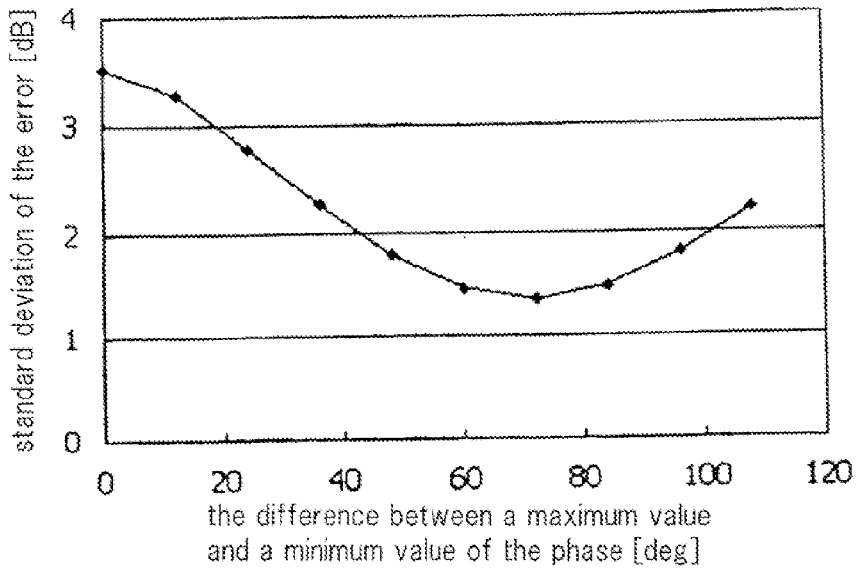
FIG. 9 is a graph showing errors between a radiation pattern shown in FIG. 8 and an ideal curve.

FIG. 9 is a graph showing an error between the radiation pattern and ideal curve (cosec square curve) shown in FIG. 8. The vertical axis represents the standard deviation of the error, while the horizontal axis represents the difference between a maximum value and a minimum value of the phase in the second phase distribution. Considering the effect of ripple reduction from the graph of FIG. 9, it is understood that the difference between the maximum value and the minimum value of the second phase distribution is preferably in a range of approximately 30 degrees to approximately 110 degrees, and an optimal effect is demonstrated at approximately 70 degrees.

Figure 10A:
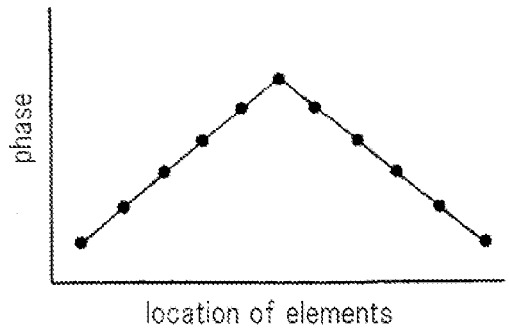
FIG. 10A is a diagram showing another example of a second phase distribution in the first embodiment.
Figure 10B:
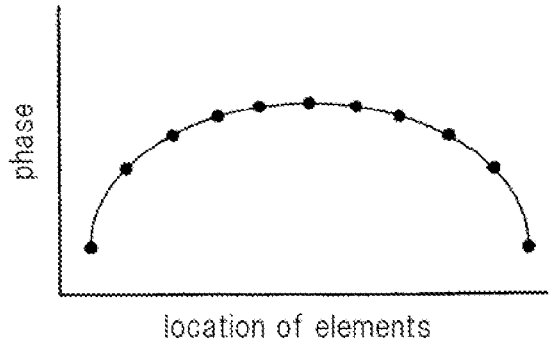
FIG. 10B is a diagram showing a further example of the second phase distribution in the first embodiment.
Figure 10C:
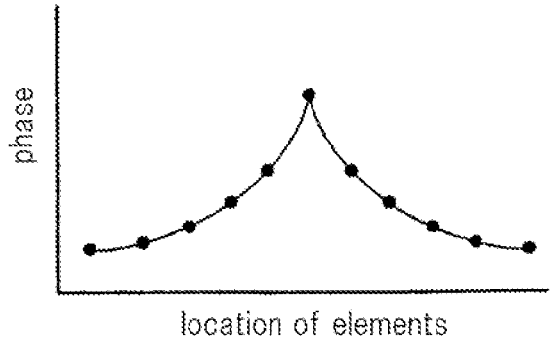
FIG. 10C is a diagram showing a further example of the second phase distribution in the first embodiment.

Notably, the second phase distribution is not limited to that shown in FIG. 7. FIGS. 10A through 10C are diagrams showing other examples of the second phase distribution. FIG. 10A shows the second phase distribution with a larger slope of the linear function than that shown in FIG. 7. FIG. 10B shows a phase distribution in like a parabolic shape (quadric function), where a change in phase between adjacent elements gradually increases from the center to the ends. In FIG. 10C, a change in phase between adjacent elements gradually decreases from the center to the ends, contrary to FIG. 10B. In either of the phase distributions, the phase is greater at an element that is further away from the center.

Next, a description will be given of the operation of the antenna device according to this embodiment. The operation will be described along the flow of a signal when the signal is transmitted from a base station to a terminal station.

In FIG. 4, a signal is applied from the base station body (not shown) to the input port of divider/combiner circuit 12 in feed circuit 10. Divider/combiner circuit 12 generates radio-waves with the amplitude distribution shown in FIG. 6 and the first phase distribution shown in FIG. 7 for the arrangement of a plurality of antenna elements 20, and divides the signal into the generated radio-waves which are then sent to phase circuit 14-1.

Phase circuit 14-1 adds a second phase distribution to the first phase distribution shown in FIG. 7, corresponding to the arrangement of the plurality of antenna elements 20, for the radio-waves received from divider/combiner circuit 12, and sends the resulting radio-waves to the plurality of antenna elements 20. In this way, the radio-waves with the combined phase shift distribution shown in FIG. 7 are applied to respective antenna elements 20 in correspondence to the arrangement of the plurality of antenna elements, and radiated from antenna elements 20. The radio-waves radiated from antenna elements 20 are combined at a remote location to form the radiation pattern shown in FIG. 8.

Next, a description will be given of the reason for which errors are reduced by adding the second triangular phase distribution shown in FIG. 7.

Generally, when a phase distribution presents a linear characteristic (which may be inclined), combined electric fields of radio-waves at a remote location from an antenna device periodically strengthen together on the plus side or strengthen together in the minus side, so that the resulting radiation pattern presents a characteristic with fluctuations (ripples). In contrast to this, when a phase distribution is a triangular phase distribution like the second phase distribution shown in FIG. 7, the following actions are involved. In FIG. 7, by adding the second phase distribution to the first distribution, a fluctuation characteristic of a radiation pattern formed by the phase distribution on the left side from the center, and a fluctuation characteristic of a radiation pattern formed by the phase distribution on the right side from the center cancel each other (compensate). Consequently, the fluctuation characteristic (ripple characteristic) is reduced in the radiation pattern, resulting in a more ideal radiation pattern.

While this embodiment has been described for a scenario where a signal is transmitted from a base station to a terminal station, operations involved in the reception of a signal by the base station from the terminal station are similar except that the flow of the signal is reverse to that in the transmission, so that a detailed description thereon is omitted. From the fact that phase circuit 14-1 adds the second phase distribution to a signal received from divider/combiner circuit 12, and removes the second phase distribution from a signal when it receives the signal through antenna elements 20, phase circuit 14-1 is equivalent to an exemplary configuration of phase adding/removing means of the present invention.

The following advantages can be provided by the foregoing embodiment.

Fluctuations against an ideal radiation pattern are reduced, as compared with the antenna device of Document 1. A uniform radio-wave propagation environment can be provided irrespective of the distance from a base station, as compared with the antenna device of Document 1, thus making it possible to provide a high communication quality to a terminal station.

Second Embodiment

In the first embodiment, the added phase distribution is in the shape of mountain, whereas in this embodiment, an added phase distribution is in the shape of valley. Since the antenna device of this embodiment is similar in configuration to the first embodiment except for the configuration of the phase circuit, a detailed description thereof is omitted, and those parts different from the first embodiment will be described in detail.

A description will be given of the configuration of the phase circuit in this embodiment. In this embodiment, phase circuit 14-1 in the first embodiment is replaced with phase circuit 14-2 described below.

Figure 11:
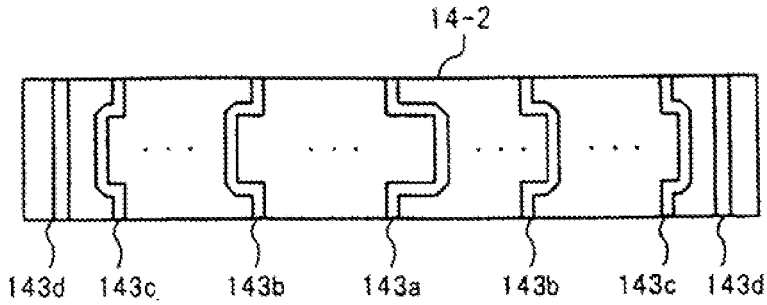
FIG. 11 is a diagram showing an exemplary configuration of a phase circuit in a second embodiment.

FIG. 11 is a diagram showing an exemplary configuration of the phase circuit. As shown in FIG. 11, phase circuit 14-2 comprises transmission lines 143*a*-143*d* corresponding to antenna elements 20. As is the case with FIG. 5, part of transmission lines is omitted in the illustration.

In this embodiment, transmission line 143*a* is connected to the central element among a plurality of antenna elements 20 arranged side by side. Other transmission lines 143*b*-143*d* are adjusted in length such that they are in line symmetry about central transmission line 143*a*. Also, transmission lines 143*b*-143*d* are adjusted in length such that the phase is advanced more at a transmission line further away from central transmission line 143*a*. Respective transmission lines 143*a*-143*d* are adjusted in length such that the phase of a radio-wave input from divider/combiner circuit 12 is converted to a predetermined phase.

Figure 12:
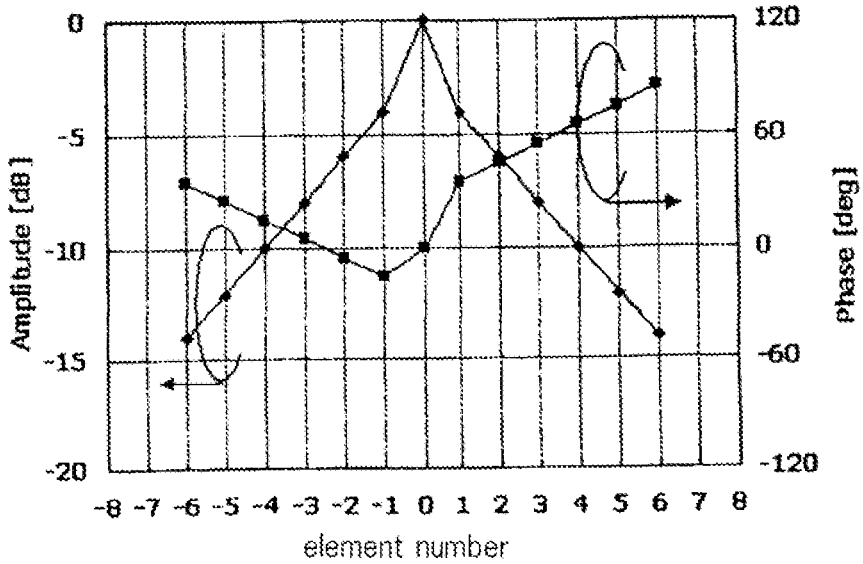
FIG. 12 is a graph showing an example of an amplitude distribution and a phase distribution of the second embodiment.

FIG. 12 is a graph showing an example of an amplitude distribution and a phase distribution of the antenna device of this embodiment. The horizontal axis of the graph indicates the locations of the antenna elements, and the vertical axis represents the amplitude on the left scale, and represents the phase on the right scale, as is the case with those described in FIG. 6. The sign of the phase indicates an advanced phase when it is positive, and a delayed phase when it is negative. The amplitude distribution and phase distribution are illustrated on the basis of antenna element labeled No. 0.

The phase distribution in radio-waves of this embodiment presents a uniformly inclined straight line from antenna element No. +1 to antenna element No. +6. Also, the phase distribution presents a uniformly inclined straight line from antenna element No. −1 to antenna element No. −6. The straight line accompanied with plus numbers of antenna elements differs from the straight line accompanied with minus numbers of antenna elements as regards the sign of slope, but their slopes have an equal absolute value. As compared with FIG. 6 in the first embodiment, the slope of the straight line on the plus side changes places with that on the minus side in this distribution.

Figure 13:
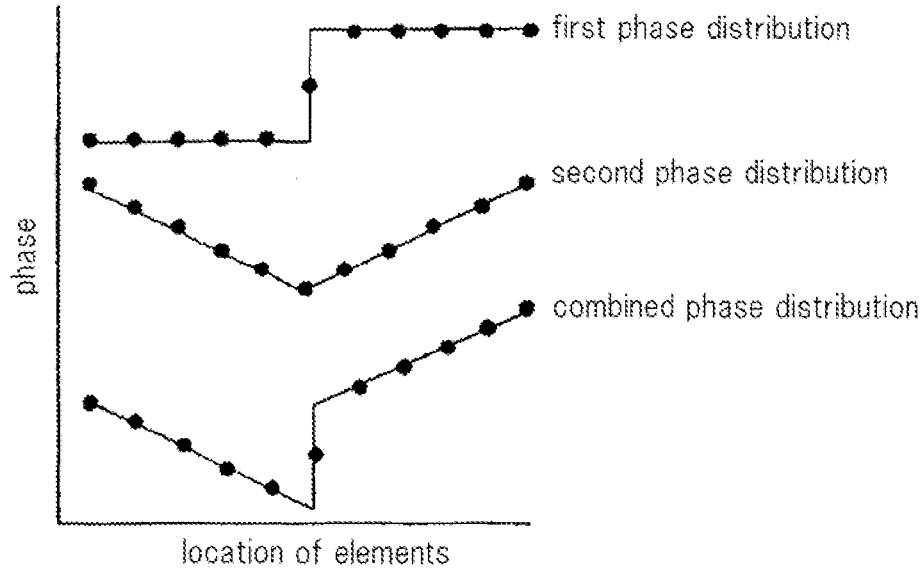
FIG. 13 is a diagram for describing a phase combination method in the second embodiment.

FIG. 13 is a diagram for describing a phase combination method in this embodiment. The horizontal axis represents the location of antenna elements, and the vertical axis represents the phase, as is the case with FIG. 7.

Assume that a first phase distribution is a phase distribution of a radio-wave generated by divider/combiner circuit 12, and a second phase distribution is a phase distribution added to the first phase distribution by phase circuit 14-2, and a combined phase distribution is a combination of these two phase distributions, as labeled in the first embodiment.

As shown in FIG. 13, the second phase distribution is in the shape of a valley, where uniformly inclined straight lines, respectively, on the plus side and minus side of the antenna elements, are centered at antenna element No. 0, and are connected to each other at the center. The second phase distribution is in the shape of a mountain in the first embodiment, whereas the second phase distribution is in the shape of a valley in the second embodiment. The phase advance is greater at an element that is further away from the central antenna element. The straight line on the plus side and the straight line on the minus side are represented by linear functions, and differ from each other as regards the sign of slope, but are equal in the absolute value of slope. Accordingly, the second phase distribution exhibits an even function characteristic centered on a vertical axis which passes through antenna element 20 No. 0.

The first phase distribution is similar to the phase distribution described in FIG. 7. When the first phase distribution is combined with the second phase distribution, the resulting combined phase distribution is as shown in FIG. 13. This distribution is comparable to the phase distribution shown in FIG. 12.

Figure 14:
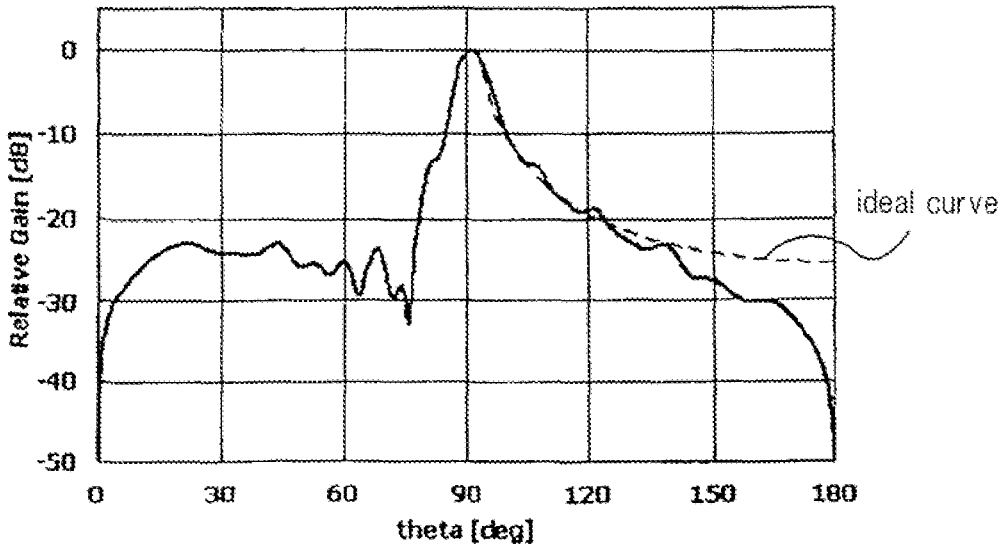
FIG. 14 is a graph showing a radiation pattern by the antenna device of the second embodiment.

FIG. 14 is a graph showing a radiation pattern of the antenna device of this embodiment. A radiation pattern depicted by a solid line is generated when 13 antenna elements 20 are arranged at intervals of approximately 0.7λ in a direction perpendicular to the ground in the antenna device of the present invention. A broken line represents an ideal curve (cosec square curve). As shown in FIG. 14, even if the second phase distribution is in the shape of valley, a more ideal radiation pattern is generated as is the case with the first embodiment.

In this regard, since optimal value for the difference between a maximum value and a minimum value of the phase in the second phase distribution is similar to that described in the first embodiment, a detailed description is omitted here.

Figure 15A:
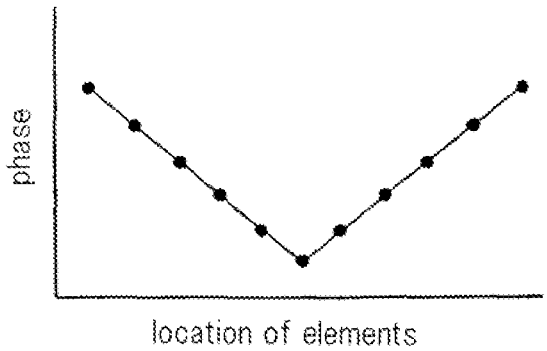
FIG. 15A is a diagram showing another example of a second phase distribution in the second embodiment.
Figure 15B:
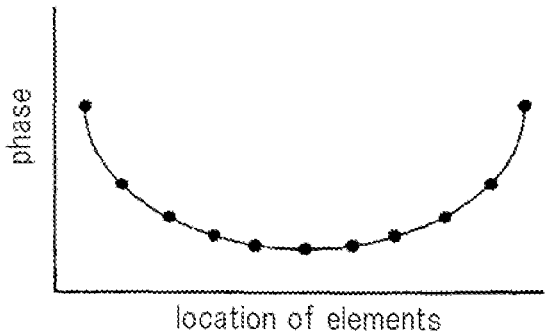
FIG. 15B is a diagram showing a further example of a second phase distribution in the second embodiment.
Figure 15C:
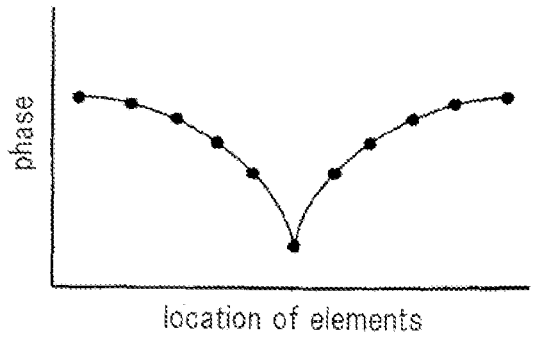
FIG. 15C is a diagram showing a further example of the second phase distribution in the second embodiment.

Also, the second phase distribution is not limited to the case shown in FIG. 13. FIGS. 15A through 15C are diagrams showing other examples of the second phase distribution. FIG. 15A shows a linear function, the slope of which is larger than that shown in FIG. 13. FIG. 15B shows a phase distribution which appears to be an up-side-down oriented parabolic shape, where a change in phase between adjacent elements gradually increases from the center to the ends. FIG. 15C, contrary to FIG. 15B, shows a phase distribution where a change in phase between adjacent elements gradually decreases from the center to the ends. In any of the phase distributions, the phase advances at a location further away from the center.

This embodiment also provides similar advantages to those of the first embodiment. Since this embodiment can be implemented when a phase circuit is designed for forming the second phase distribution, the degree of freedom is increased in designing.

Third Embodiment

The phase distribution formed by phase circuit 14-1, 14-2 in the first and second embodiments may be made variable as in this embodiment. Since an antenna device of this embodiment is similar in configuration to the first embodiment except for the configuration of the phase circuit, a detailed description thereof is omitted, and parts that are different from the first embodiment will be described in detail.

Figure 16:
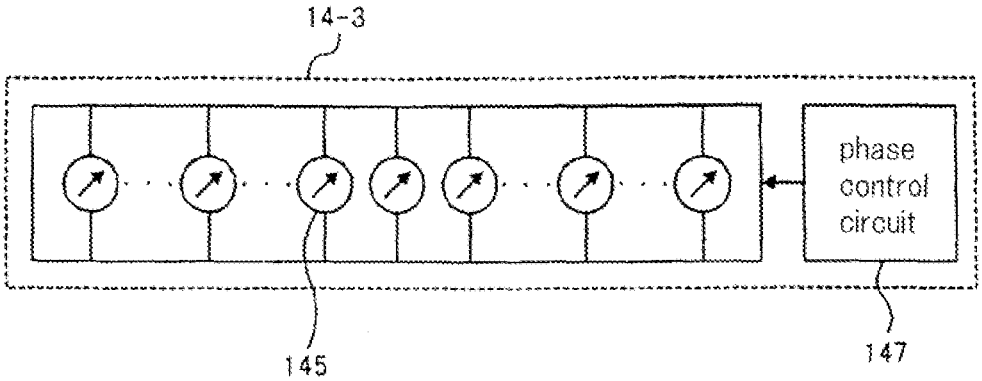
FIG. 16 is a block diagram showing another exemplary configuration of the phase circuit in the first or second embodiment.

FIG. 16 is a block diagram showing an exemplary configuration of the phase circuit in this embodiment.

As shown in FIG. 16, phase circuit 14-3 comprises variable phase shifters 145 provided for respective ones of a plurality of antenna elements 20, and phase control circuit 147 for adjusting the phase of each variable phase shifter 145.

In an array antenna, when one attempts to increase the gain of the antenna, ripples increase in a radiation pattern. Conversely, when one attempts to reduce ripples, the gain of the antenna decreases. In this way, the gain of an antenna and ripples of a radiation pattern are in a trade-off relationship. In accordance with a particular purpose which gives a higher priority to an increased gain or reduced ripples, phase circuit 14-3 shown in FIG. 16 can be used to adjust the phase of each variable phase shifter 145.

Next, the characteristics are compared between the respective antenna devices of the first and second embodiments and the antenna device with the distribution shown in FIG. 2 which comprises an increased number of antenna elements.

Figure 17:
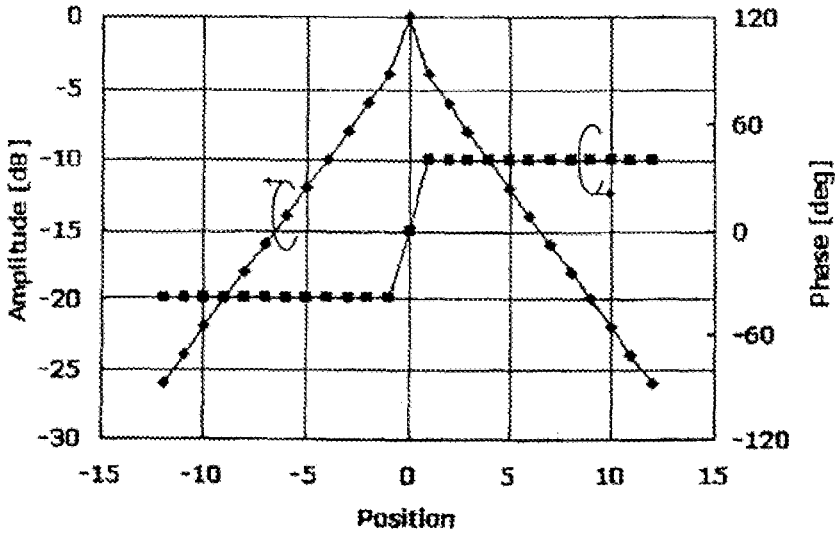
FIG. 17 is a graph showing an amplitude distribution and a phase distribution of antenna device which serves as a comparative example.

FIG. 17 is a graph showing the amplitude distribution and a phase distribution of an antenna device which serves as a comparative example. In the antenna device of the comparative example, antenna elements are arranged at intervals of approximately 0.7λ. Also, the number of antenna elements is chosen to be 25, as shown in FIG. 17.

Figure 18:
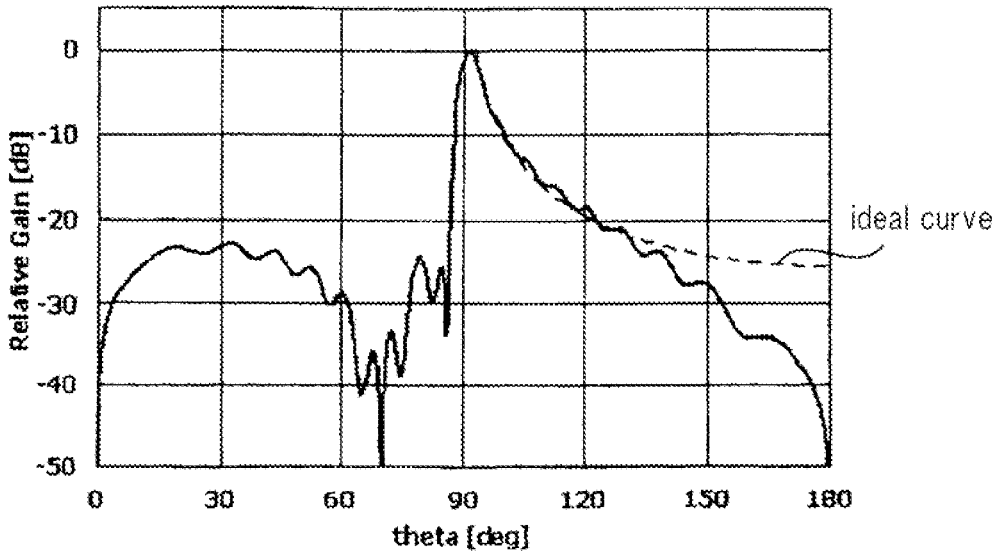
FIG. 18 is a graph showing a radiation pattern by radio-waves of the distributions shown in FIG. 17.

FIG. 18 is a graph showing a radiation pattern by radiowaves of a distribution shown in FIG. 17. A solid line represents the radiation pattern of the comparative example, and a broken line represents an ideal curve (cosec square curve). As shown in FIG. 18, the radiation pattern is closer to the ideal curve, as compared with the distribution of FIG. 2, and is equivalent to FIGS. 8 and 14. It is understood from the result of this comparison that the antenna device of this embodiment can generate a radiation pattern equivalent to the antenna device of FIG. 17 which comprises antenna elements whose number is twice as much.

As described above, the antenna device of this embodiment can improve the characteristic of a radiation pattern without increasing the number of antenna elements, and without increasing the configuration of the overall antenna, as compared with the antenna device of Document 1. Since the antenna device need not be increased in size, the antenna device can be installed in a saved space, and the manufacturing cost can also be prevented from increasing.

While the foregoing embodiments have been described in connection with the antenna device which comprises 13 antenna elements, the number of antenna elements may be at least eight or more, and a maximum number of antenna elements may be equal to or less than that of another associated antenna device. Also, the distance between antenna elements may be in a range of 0.5 to 1λ. Further, the present invention can be applied to array antennas in general.

As an exemplary effect of the present invention, a radiation pattern closer to an ideal one can be generated without increasing the number of antenna elements, thus improving the characteristics of the radiation pattern.

While the invention has been particularly shown and described with reference to exemplary embodiments and examples thereof, the invention is not limited to these embodiments and examples. It will be understood by those of ordinary skill in the art that various changes in form and details may be made therein without departing from the spirit and scope of the present invention as defined by the claims.

The invention claimed is:

1. An antenna device comprising:

a plurality of antenna elements arranged in an array configuration, that transmits or receives signals;

divider/combiner unit that divides or combines a received signal into signals having an amplitude distribution represented by an even function having a point of symmetry at the center in said array configuration of said plurality of antenna elements and having a first phase distribution represented by an odd function having a point of symmetry at the center in said array configuration of said plurality of antenna elements; and phase adding/removing unit that adds phases having a second phase distribution represented by an even function having a point of symmetry at the center in said array configuration of said plurality of antenna elements, to said signals, or removes said phases from said signals.

2. The antenna device according to claim 1, wherein said second phase, distribution presents a phase whose advance is greater at a location that is further away from the center.

3. The antenna device according to claim 1, wherein said second phase distribution presents a phase whose delay is greater at a location that is further away from the center.

4. The antenna device according to claim 1, wherein amplitudes of said signals reach a maximum value at the center, and become smaller at a location further away from the center.

5. The antenna device according to claim 1, wherein said second phase distribution is represented by a linear function or a quadric function.

6. The antenna device according to claim 1, wherein said plurality of antenna elements are arranged at equal intervals.

7. The antenna device according to claim 1, wherein said divider/combiner unit is a divider/combiner circuit.

8. The antenna device according to claim 1, wherein said phase adding/removing unit is a phase circuit.

9. A feed circuit connected to a plurality of antenna elements arranged in an array configuration, comprising:

a divider/combiner circuit that divides or combines a received signal into signals having an amplitude distribution represented by an even function having a point of symmetry at the center in said array configuration of said plurality of antenna elements and having a first phase distribution represented by an odd function having a point of symmetry at the center in said array configuration of said plurality of antenna elements; and a phase circuit that adds phases having a second phase distribution represented by an even function having a point of symmetry at the center in said array configuration of said plurality of antenna elements, to said signals, or removes said phases from said signals.

10. A radio-wave transmission/reception method comprising:

dividing a received signal into signals having an amplitude distribution represented by an even function having a point of symmetry at the center of a signal distribution and having a first phase distribution represented by an odd function having a point of symmetry at the center in said signal distribution;

adding phases having a second phase distribution represented by an even function having a point of symmetry at the center of said signal distribution, to said signals; and transmitting signals to which said phases have been added.

11. The radio-wave transmission/reception method according to claim 10, wherein said second phase distribution presents a phase whose advance is greater at a location that is further away from the center.

12. The radio-wave transmission/reception method according to claim 10, wherein said second phase distribution presents a phase whose delay is greater at a location that is further away from the center.

13. The radio-wave transmission/reception method according to claim 10, wherein amplitudes of said signals reach a maximum value at the center, and become smaller at a location further away from the center.

14. A radio-wave transmission/reception method comprising:

receiving signals having an amplitude distribution represented by an even function having a point of symmetry at the center of a signal distribution, and said signals being combined with a first phase distribution represented by an odd function having a point of symmetry at the center of said signal distribution, and a second phase distribution represented by an even function having a point of symmetry at the center of said signal distribution;

removing phases having said second phase distribution from said signals; and combining signals having said first phase distribution.

15. The radio-wave transmission/reception method according to claim 14, wherein said second phase distribution presents a phase whose advance is greater at a location that is further away from the center.

16. The radio-wave transmission/reception method according to claim 14, wherein said second phase distribution presents a phase whose delay is greater at a location that is further away from the center.

17. The radio-wave transmission/reception method according to claim 14, wherein amplitudes of said signals reach a maximum value at the center, and become smaller at a location further away from the center.

* * * * *